US011629720B2

(12) United States Patent
Bierig et al.

(10) Patent No.: US 11,629,720 B2
(45) Date of Patent: Apr. 18, 2023

(54) THRUST BOX AND SKID FOR A HORIZONTALLY MOUNTED SUBMERSIBLE PUMP

(71) Applicant: Extract Management Company, LLC, Tulsa, OK (US)

(72) Inventors: Kevin Bierig, Tulsa, OK (US); James Gardner, Tulsa, OK (US)

(73) Assignee: Extract Management Company, LLC, Tulsa, OK (US)

( * ) Notice: Subject to any disclaimer, the term of this patent is extended or adjusted under 35 U.S.C. 154(b) by 303 days.

(21) Appl. No.: 17/036,894

(22) Filed: Sep. 29, 2020

(65) Prior Publication Data

US 2022/0099095 A1 Mar. 31, 2022

(51) Int. Cl.

| | |
|---|---|
| ***F04D 13/08*** | (2006.01) |
| ***F04D 29/60*** | (2006.01) |
| ***F04D 29/046*** | (2006.01) |

(52) U.S. Cl.

CPC ..... *F04D 13/086* (2013.01); *F04D 29/0462* (2013.01); *F04D 29/606* (2013.01); *F05B 2240/52* (2013.01)

(58) Field of Classification Search

CPC .... F04D 13/08; F04D 13/086; F04D 29/0413; E21B 43/128

See application file for complete search history.

(56) References Cited

U.S. PATENT DOCUMENTS

| | | | | |
|---|---|---|---|---|
| 8,246,251 | B1 * | 8/2012 | Gardner | F04D 29/606 384/420 |
| 10,288,119 | B2 * | 5/2019 | Nelson | F04D 29/061 |
| 2017/0130730 | A1 * | 5/2017 | Torkildsen | F04D 19/024 |
| 2018/0298910 | A1 * | 10/2018 | Watson | F04D 29/0413 |
| 2019/0271324 | A1 * | 9/2019 | Watson | E21B 43/38 |

OTHER PUBLICATIONS

Definition of "shaft seal", from https://www.ksb.com/centrifugal-pump-lexicon/shaft-seal/191452 (Mar. 2, 2021).

* cited by examiner

*Primary Examiner* — Sabbir Hasan

*Assistant Examiner* — Jackson N Gillenwaters

(74) *Attorney, Agent, or Firm* — Hunton Andrews Kurth LLP

(57) ABSTRACT

A thrust box with improved cooling comprises a case having an interior, a first passageway and an opposing second passageway. A shaft passes through the case and the first and second passageway. A thrust runner is secured to the shaft and a pump ring is attached to the thrust runner. Advantageously, the pump ring facilitates oil rate circulation and cooling among other benefits.

15 Claims, 10 Drawing Sheets

THRUST BOX AND SKID FOR A HORIZONTALLY MOUNTED SUBMERSIBLE PUMP

FIELD OF THE INVENTION

The present invention relates generally to an improved thrust box for use in, for example, horizontally mounted submersible pumps. More specifically, the present invention relates to a thrust box and its use in some embodiments in conjunction with a horizontally mounted submersible pump.

BACKGROUND AND SUMMARY

Submersible pumps like the kind used in oil fields are designed for downhole applications. They typically have a cylindrical shape with a diameter that allows them to be inserted within the casing of the well. The length of the pump can vary from 20 feet to 80 feet or more depending upon the amount of pressure and volume necessary for the application. These submersible pumps have the capability of pumping extremely large volumes of fluid in a very short time. Because of their ability to pump large volumes of fluid very rapidly, there are many surface applications for these submersible pumps. In order to use the pumps on the surface it is necessary to mount the pump horizontally on a skid. The pump can then be powered with a standard combustion engine or electric motor depending upon the utilities available at the application site.

In using the submersible pumps a great amount of thrust is generated by the force of the fluid flowing through the pump. Because of this force, it is necessary to have a thrust box between the pump and the electric motor. The drive shaft of the electric motor is coupled to the drive shaft of the thrust box. The opposite end of the thrust box drive shaft is coupled to the submersible pump. The thrust box is designed to absorb the thrust generated by the pump and transfer it back to the pump housing. This prevents the thrust generated by the pump from being absorbed by the combustion engine or electric motor driving pump. If the combustion engine or electric motor were coupled directly to the submersible pump this force would quickly destroy the bearings of the engine or motor.

There currently are many thrust boxes on the market, however, there are several shortcomings in their design. First, the thrust boxes on the market do not have a circulated and cooled lubricant. This creates problems with heat build up and lubricant failure which greatly shortens the life of the thrust box. Second, the thrust boxes rely upon seals which are held in place by clip rings mounted in grooves in the shaft. The groove cut in the shaft can introduce stress cracks in the shaft.

A further draw back to the prior art horizontally mounted submersible pump systems is that the skid is manufactured such that the electric motor or pump must be removed from the skid in order to remove the thrust box. The thrust box is typically the component most likely to fail. When the electric motor or engine is removed from the skid it must be realigned along with the thrust box in order to reinstall the thrust box and motor. This too leads to increased down time and loss of operating revenue for the operator.

The following described technology is made in an effort to provide a thrust box and skid for a horizontally mounted submersible pump.

To achieve the above aim, the thrust box utilizes a case having an interior, a first passageway and an opposing second passageway, a shaft passing through the case and the first and second passageway, a thrust runner keyed to the shaft, and a pump ring bolted to the thrust runner. Vanes of the pump ring change path of oil flow and force the oil wherein flow up through a space between bearing pads and the thrust runner. The pump ring vanes help change the path from a 90 degree turn and forces oil up through the space between the bearing pads and the thrust runner.

The thrust box also utilizes seals which are mounted directly to the casing. Thus reducing possible stress and fracture related problems associated with cutting grooves into the shaft. The improved thrust box also utilizes a completely flooded case interior for holding lubricant. The lubricant is pumped out of the case and through an oil filter and a heat exchanger to remove excess heat. This greatly increases the service life of the thrust box. The longevity of the seals is also aided by the fact that the lubricant is removed from the case under a vacuum pressure rather than being forced under positive pressure through the case.

A skid, if desired, may be employed with the thrust box design. In some embodiments the thrust box can be removed from the skid without first removing the pump and/or electric motor or combustion engine.

The improved thrust box also utilizes equalizing thrust bearings to transfer the force of the thrust from the shaft to the case of the thrust box and then back into the pump. The use of thrust bearings greatly reduces the number of bearings necessary over using angle needled bearings. The thrust bearings also allow the thrust box to operate both clockwise and counterclockwise without having to change out bearings as would be necessary with using angled needle bearings. In a preferred embodiment the thrust bearings are roller bearings.

The thrust bearing can be equipped with a heat sensor. This allows the monitoring of the internal temperature of the thrust bearing and not just the temperature of the lubricant thus providing indication as to maintenance problems before there is a catastrophic failure. Likewise the thrust bearing can be equipped with a load sensor. Changes of the load on the thrust bearing can provide the operator an indication of the condition of the pump.

According to the present invention, a thrust box utilizes a case having an interior, a first passageway and an opposing second passageway, a shaft passing through the case and the first and second passageway, a thrust runner keyed to the shaft, and a pump ring bolted to the thrust runner. The advantage of the present invention using the thrust box may increases flow rate of the oil and also results in a cooler bearing and thicker, better lubricating oil film.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings, in which like reference symbols indicate the same or similar components, wherein.

DETAILED DESCRIPTION OF THE INVENTION

Figure 1:
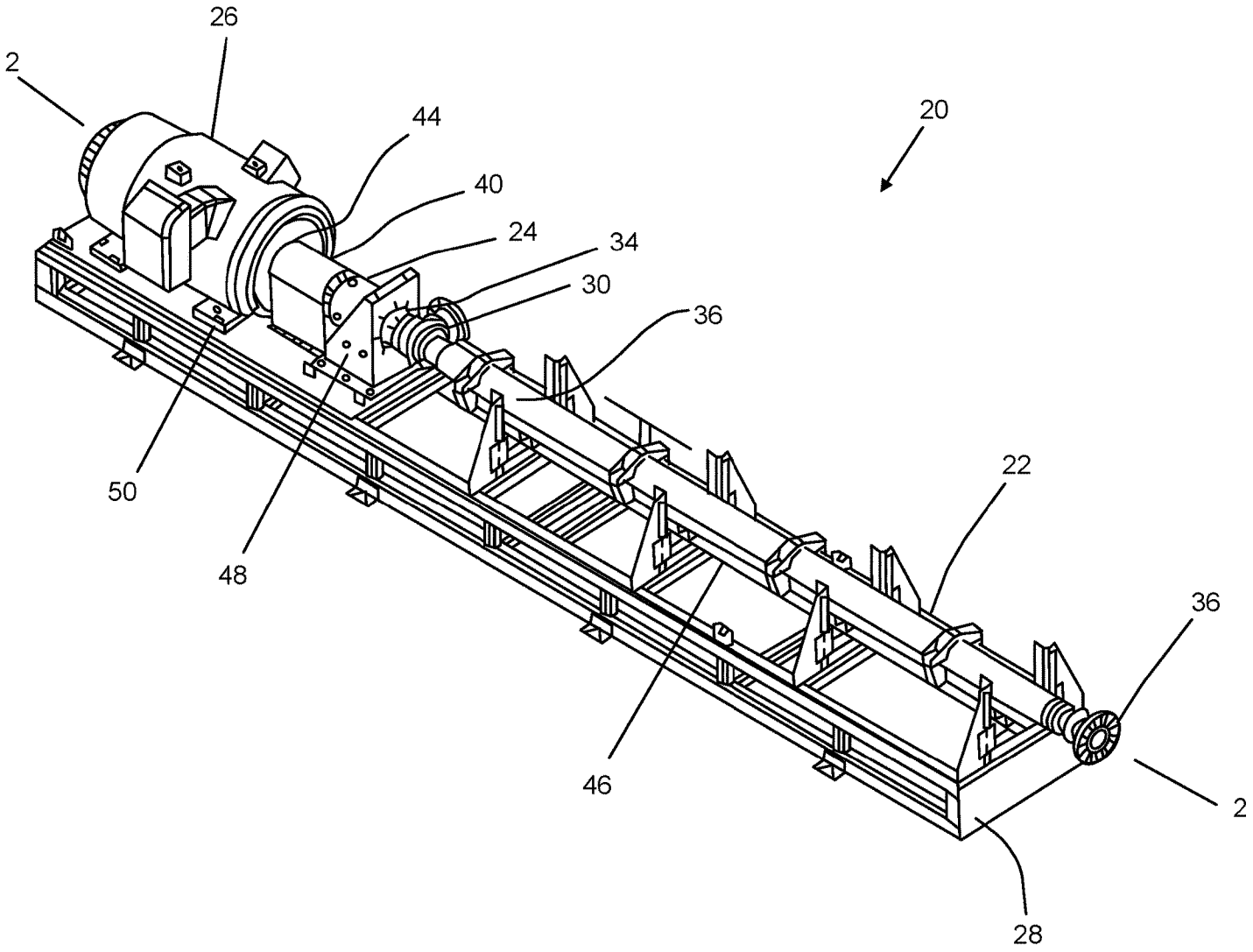
FIG. 1 is a perspective view of a skid mounted horizontal submersible pump thrust box and motor in accordance with the present invention.

The general inventive concept is described more fully below with reference to the accompanying drawings, in which exemplary embodiments of the present invention are shown. As those skilled in the art would realize, the described embodiments may be modified in various different ways, all without departing from the spirit or scope of the present invention. The present invention should not be construed as being limited to the embodiments. Accordingly, the drawings and description are to be regarded as illustrative in nature to explain aspects of the present invention and not restrictive. Like reference numerals in the drawings designate like elements throughout the specification, and thus their description have not been repeated.

Turning now to the drawings wherein like reference characters indicate like or similar parts throughout, FIG. 1 shows a skid mounted horizontal submersible pump thrust box 20 which has four main components, a submersible pump 22, a thrust chamber 24, an electric motor 26 and a skid 28. The pump 22 has an inlet 30 and an outlet 36. A first coupler 34 connects a pump shaft 36 to a first end of a shaft of the thrust chamber 24. A second coupler 40 connects a second end 42 (shown in FIG. 2 and FIG. 3) of the shaft of the thrust chamber 24 to a shaft 44 of the motor 26.

FIG. 1 shows the skid mounted horizontal submersible pump with the electric motor 26. Other drive mechanisms including but not limited to an internal combustion engine or hydraulic motor could also be used to power the horizontal submersible pump 22.

The skid 28 has a cradle 46 which supports the pump 22. A thrust chamber mounting bracket 48 holds the thrust chamber 24 in place. The skid 28 also has the motor mounting brackets 50 which hold the motor 26 in place.

When in use the water or other fluid enters the pump 22 through inlet 30 and is forced out the outlet 36. The water leaving the outlet 36 creates a tremendous amount of force or thrust directed toward the thrust chamber 24 and the motor 26. The shaft 36 of the pump 22 pushes against the first end of the shaft of the thrust chamber 24.

Figure 2:
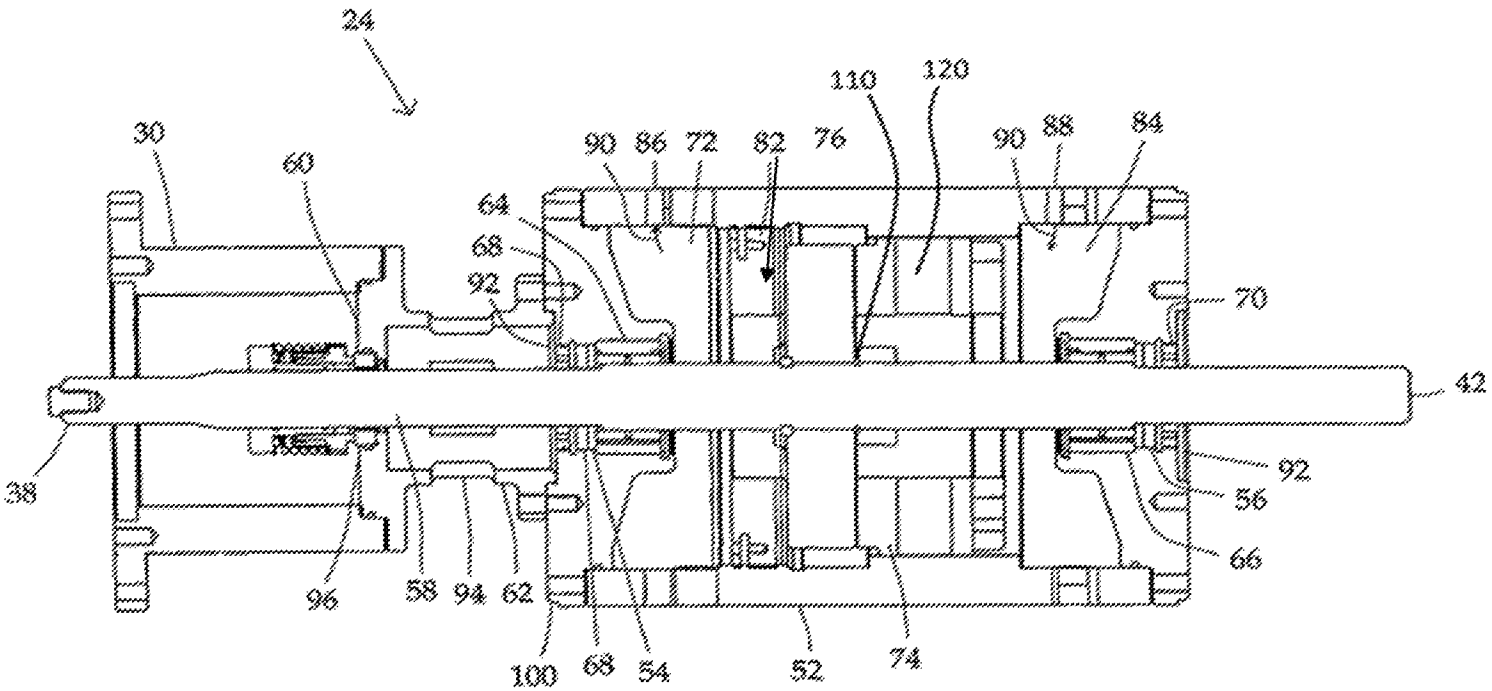
FIG. 2 is a cross-sectional view of the thrust box and pump inlet taken along the line 2-2 indicated in FIG. 1.

FIG. 2 shows a cross-section of the thrust chamber 24 and the pump inlet 30. The thrust chamber 24 has a case 52, a first passageway 54 and an opposing second passageway 56. A shaft 58 passes through the passageways 54 and 56 and extends into the inlet 30 of the pump 22 through a passageway 60. A spool 62 is located between the pump inlet 30 and the thrust chamber 24 to help maintain alignment and transfer some of the force of the thrust. The thrust chamber shaft 58 is supported in the case 52 by a first and second bearing 64 and 66. A locking collar or threaded nut 200 assists in securing the thrust runner 76 to the shaft 58.

FIG. 2 shows the first and second bearing 64 and 66 as being needle or roller bearings, however other types of bearing including but not limited to ball bearings could be used. A first and second seal 68 and 70 are located in the first and second passageways 54 and 56. The seals 68 and 70 provide a seal between the shaft 58 and the case 52. This keeps lubricant 72 in the case 52. A thrust bearing 74 is mounted to the case 52. It is preferred to use a self equalizing thrust bearing, however other types of bearings can be used.

Figure 3:
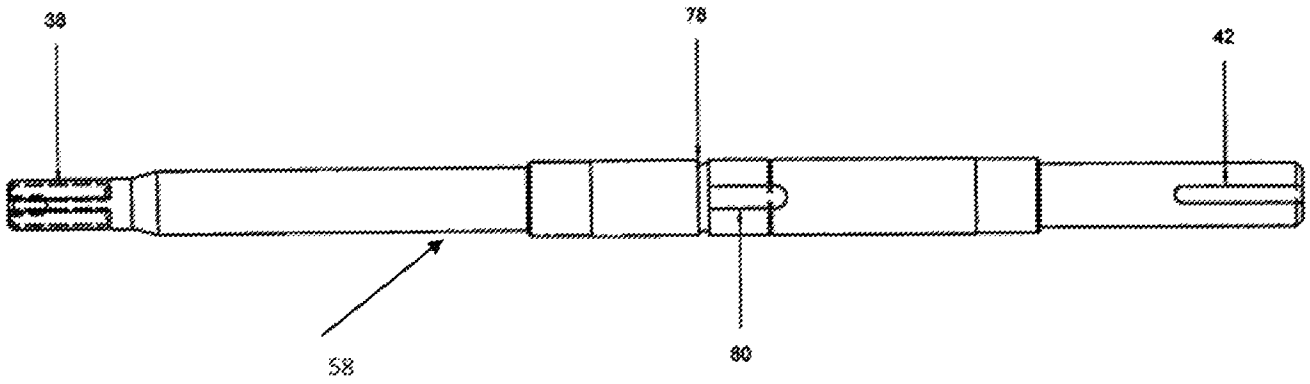
FIG. 3 is a side view of the shaft of the thrust box.

A thrust runner 76 is secured to the shaft 58 by a radial groove 78 and a keyway 80 (see FIG. 3). The force generated by the pump 22 is transferred through the shaft 58 and the thrust runner 76 into the thrust bearing 74.

On certain occasions such as if the pump is reversed the force can be in the opposite direction. In these situations the force is transferred from the shaft 58 through the thrust runner 76 and into the upthrust ring 82. The upthrust ring 82 is secured to the case 52.

Figure 8:
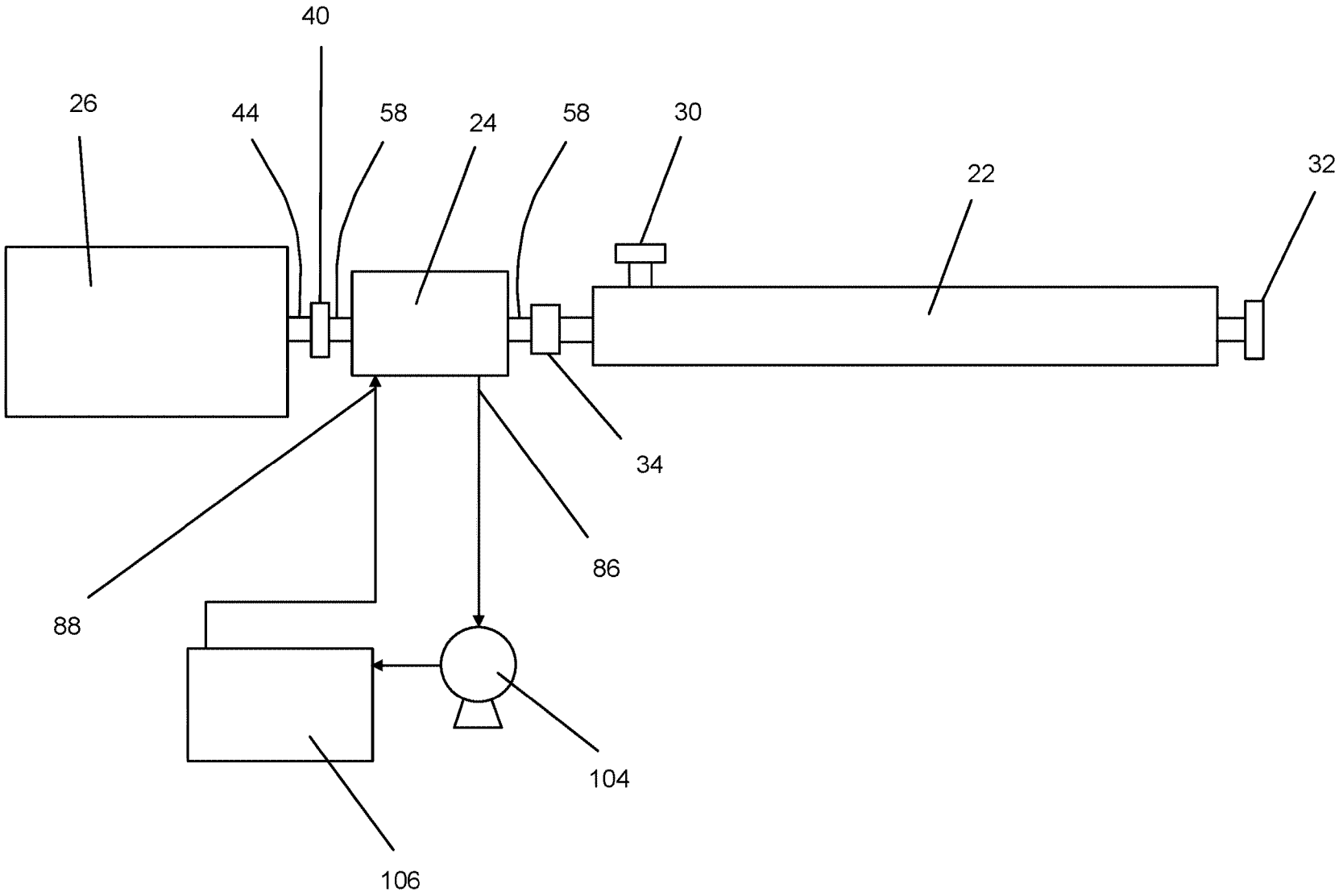
FIG. 8 is a schematic of the present invention as part of a system.

The lubricant 72 flows from an interior 84 of the case 52 by a pump 104 through the lubricant outlet 86 (see FIG. 8). The lubricant 72 is then run through a heat exchanger 106 where the heat is removed. The lubricant 72 is reintroduced into the interior 84 of the case 52 via a lubricant inlet 88. The flow of the lubricant 72 through the interior 84 of the case 52 is indicated by an arrows 90. It is preferred to maintain the interior 84 of the case 52 such that it is completely flooded with the lubricant 72. This ensures all moving internal parts are lubricated and cooled.

Figure 7:
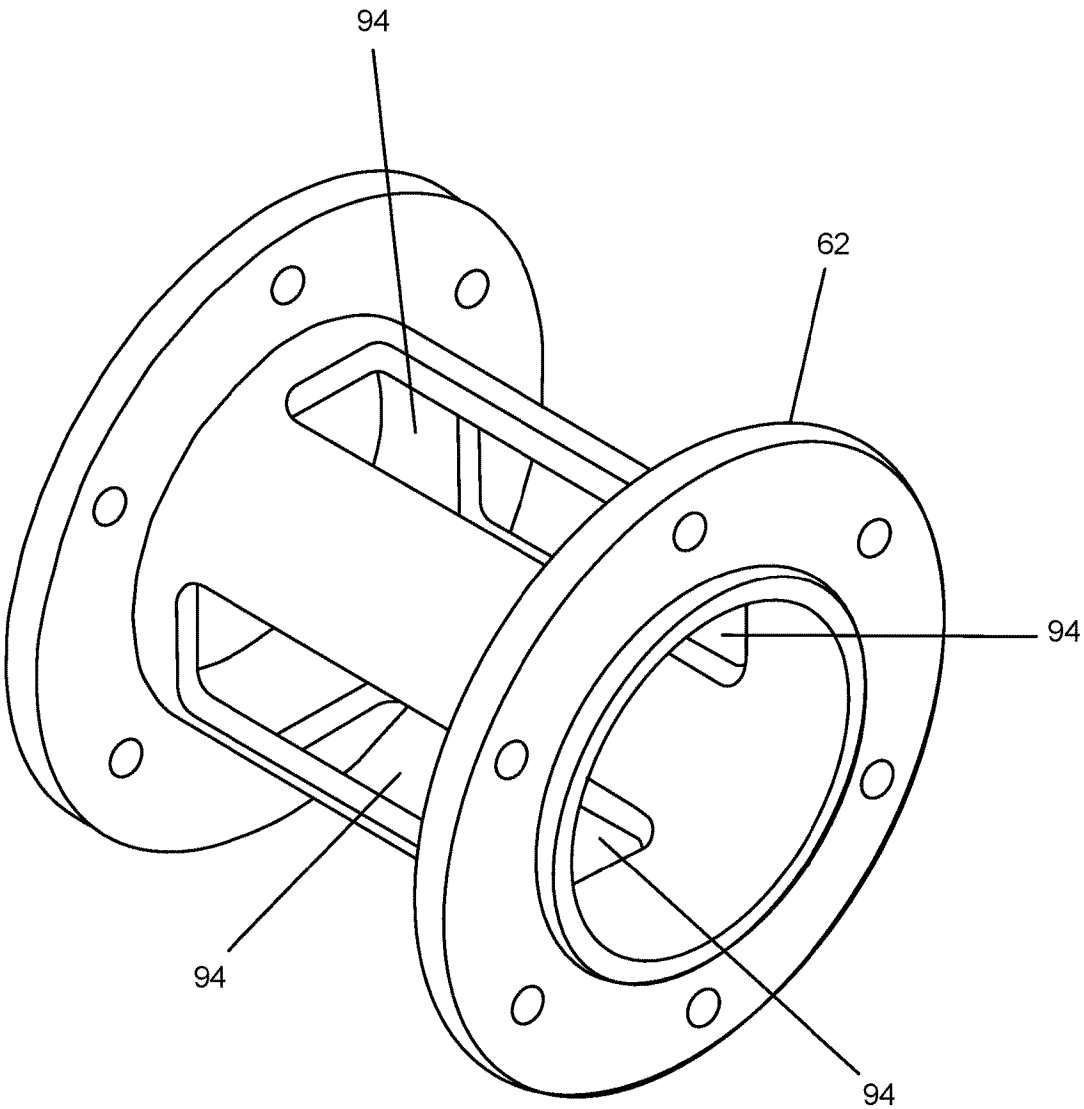
FIG. 7 is a perspective view of the spool located between the thrust chamber and submersible pump inlet.

The spool 62 located between the thrust chamber 24 and the pump 22 has one or more openings 94 (see FIG. 7). In the event the seal 96 of the pump inlet fails any liquid which passes along next to the shaft 58 will enter the spool 62 and pass through one or more of these openings 94 thus eliminating the possibility of this liquid being forced passed the thrust chamber seal 68 and into the interior 84 of the case 52.

Figure 9:
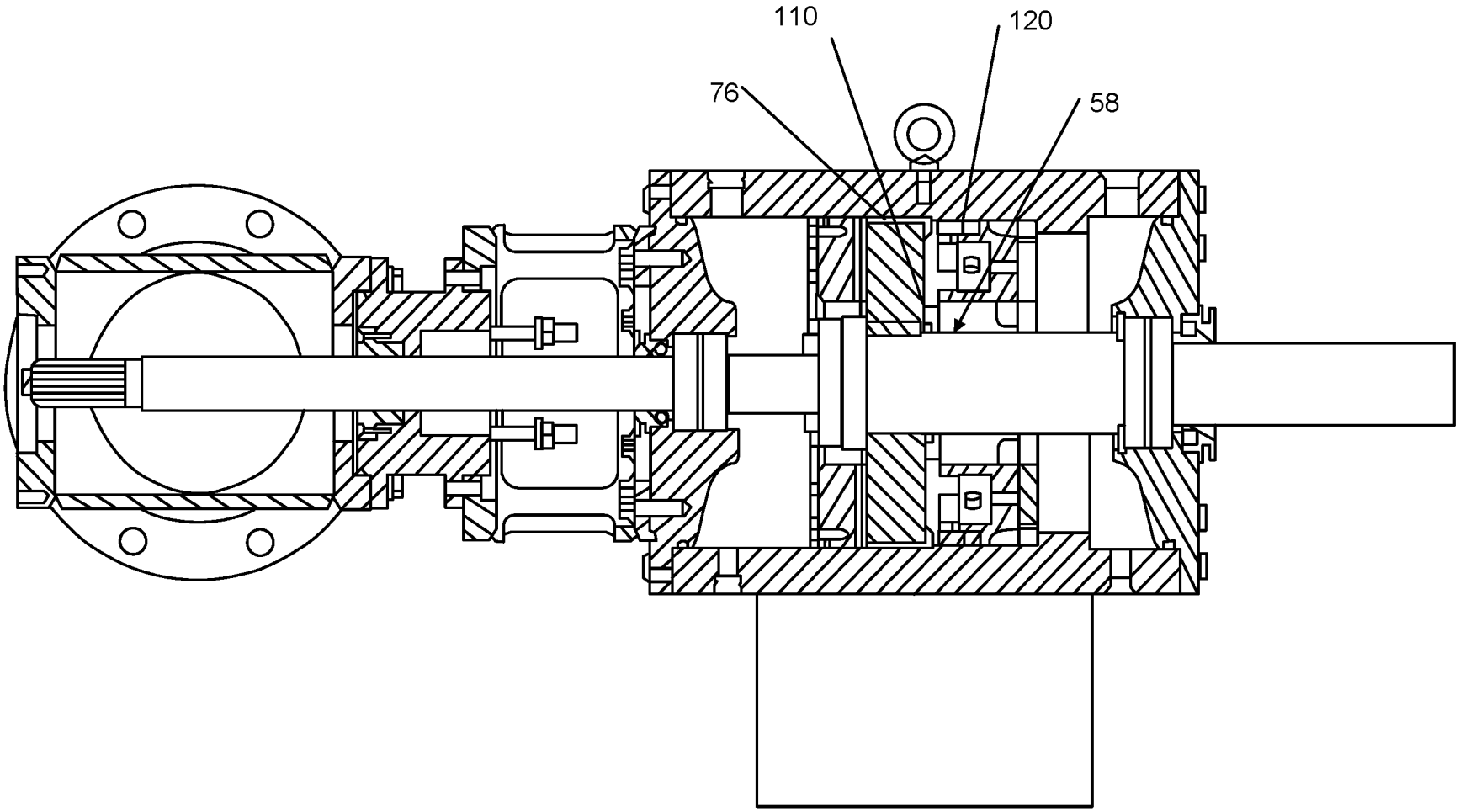
FIG. 9 is an enlarged part of the thrust box of the FIG. 2 showing a pump ring.
Figure 10:
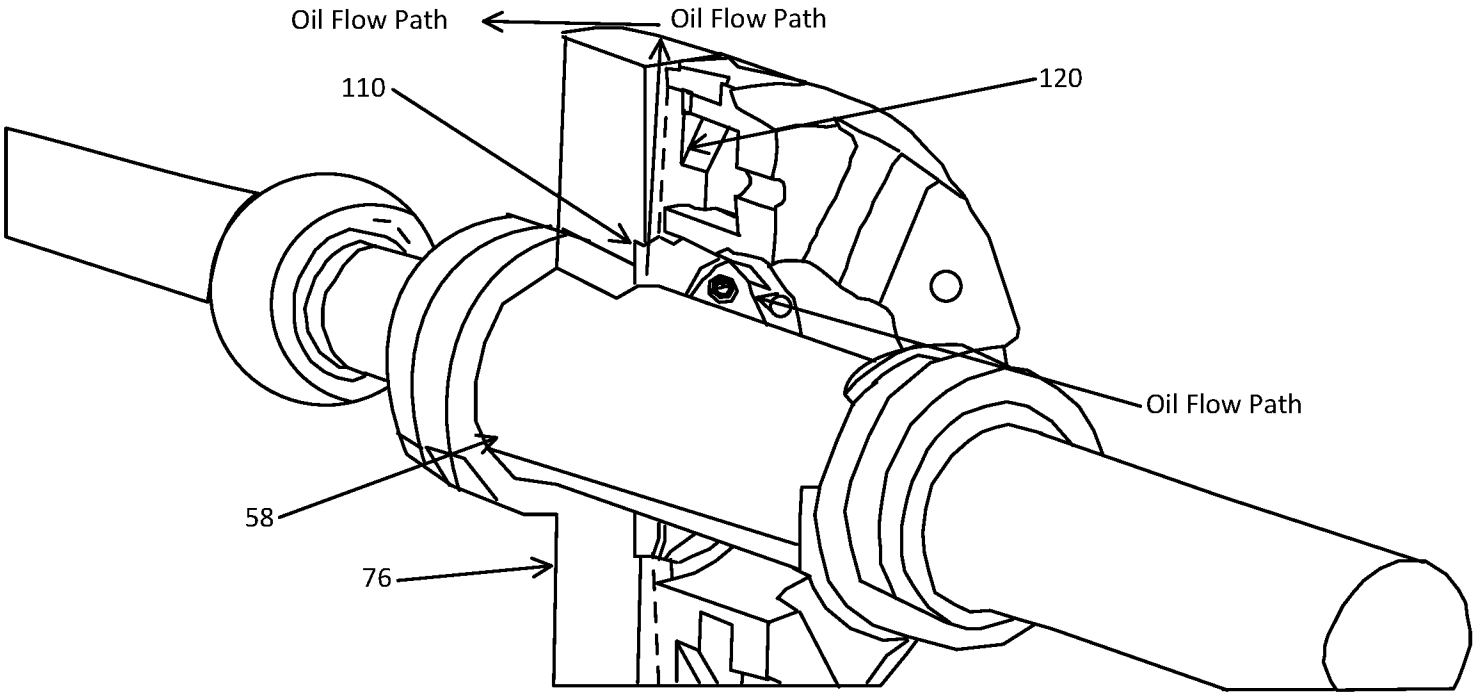
FIG. 10 is a three dimensional figure of the enlarged part of the thrust box of FIG. 9 showing oil flow path.

A pump ring 110 is attached in any convenient manner, e.g., one or more bolts, to the thrust runner 76, and a bearing assembly 120 is located next to the thrust runner 76 (see FIG. 9). Vanes of the pumping ring 110 help change a path of oil from a 90 degree turn and forces oil up through a space between the bearing assembly 120 and the thrust runner 76. This increases flow rate of the oil and also results in a cooler bearing and thicker, better lubricating oil film (see FIG. 10).

Figure 4:
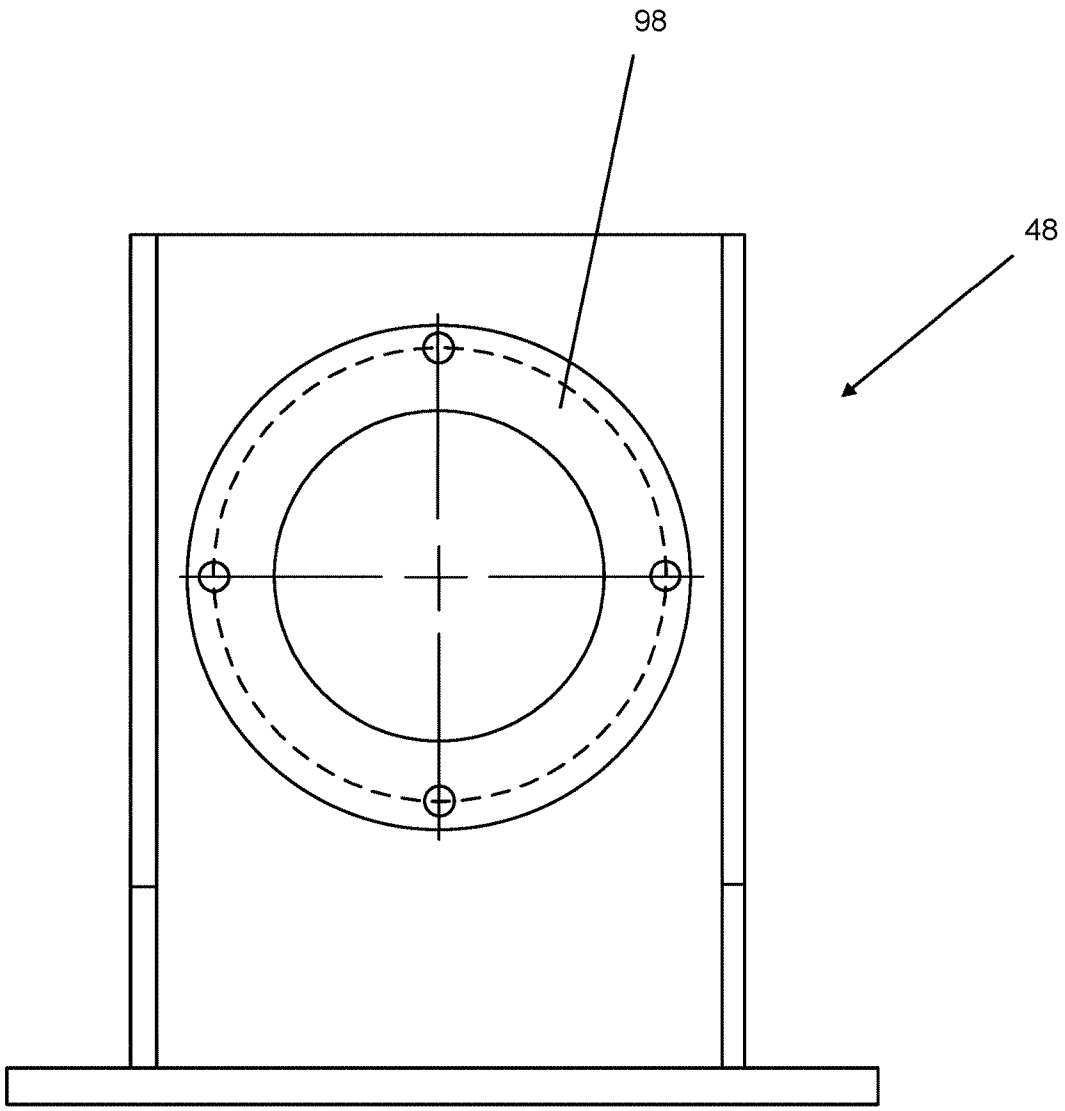
FIG. 4 is a back view of the thrust box mounting bracket.
Figure 5:
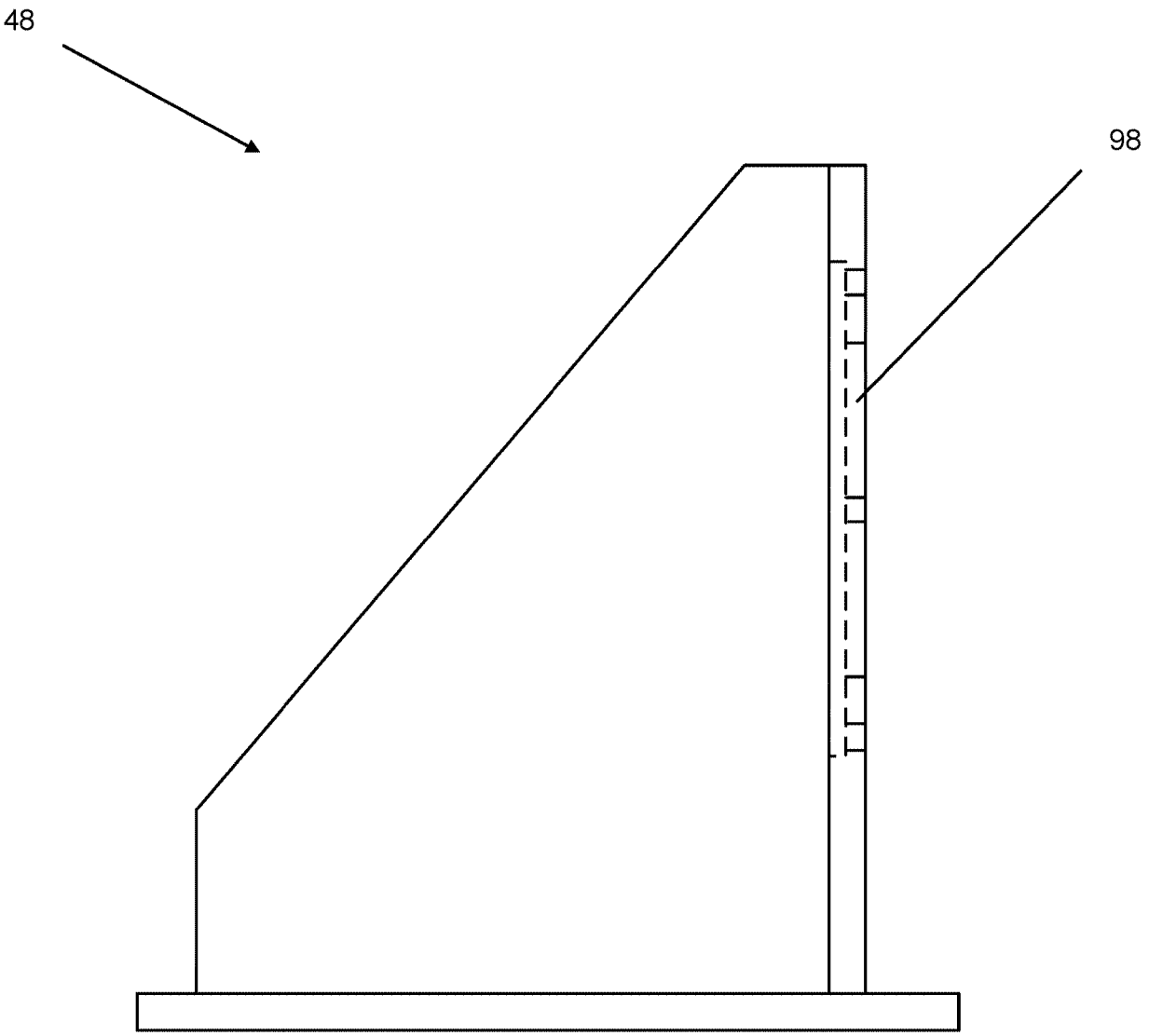
FIG. 5 is a side view of the thrust chamber mounting bracket.
Figure 6:
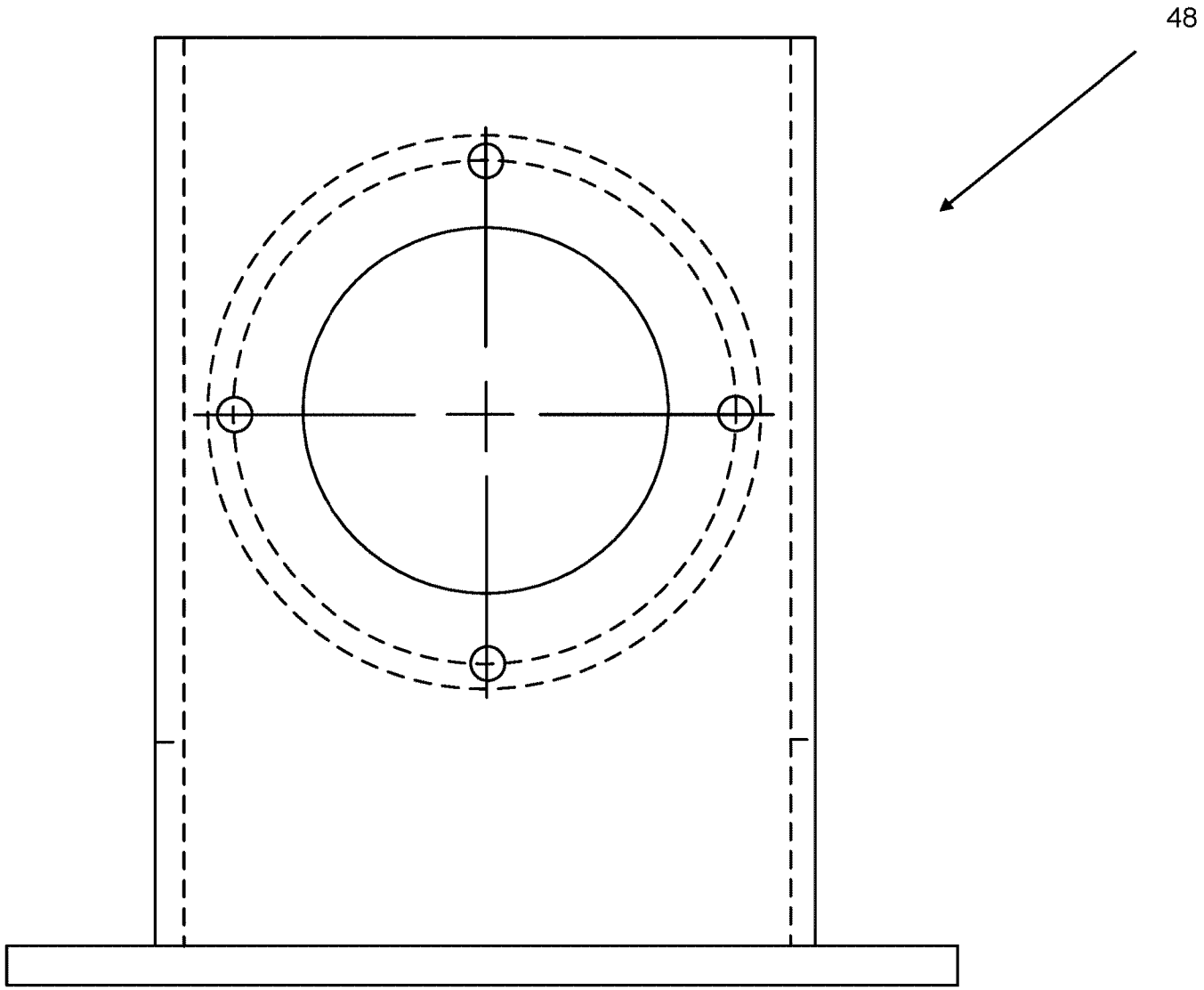
FIG. 6 is a front view of the thrust chamber mounting bracket.

Turning to FIGS. 4, 5 and 6, the thrust chamber mounting bracket 48 is secured to the skid 28. The thrust chamber mounting bracket 48 has a machine surface 98 which is complimentary to a machined surface 100 on the case 52 of the thrust chamber 24. When setting up the skid 28, the submersible pump 22 is first positioned in the cradle 46 and secured in its position. The thrust chamber mounting bracket 48 can then be located on the skid such that the thrust chamber 24 mounted on the thrust chamber mounting bracket 48 is in alignment with the submersible pump 22. Once aligned the thrust chamber mounting bracket 48 is secured to the skid, the motor 26 or other drive mechanism can then be aligned such that a shaft of the drive mechanism is aligned with the thrust chamber 24, the shaft 58 and the shaft 36 of the pump 22. Because the machine surface 98 of the thrust chamber mounting bracket 48 positively engages the machine surface 100 of the thrust chamber case 52, it ensures that the thrust chamber 24 can be removed from the thrust chamber mounting bracket 48 and then remounted and still remain in alignment with the pump 22 and the motor 26.

Often times the thrust chamber 24 fails before the pump 22 or motor 26. The prior art skid designs require that the motor or drive mechanism be removed when removing the thrust chamber. This requires that both the new replacement thrust chamber and the drive mechanism be aligned with the pump shaft thus increasing the amount of labor and down time necessary to change out a thrust chamber.

With the present design, however, the motor 26 or other drive mechanism remains in place when removing the thrust chamber thus greatly reducing the amount of down time and labor necessary to change out the thrust chamber 24. Also because of this positive location of the thrust chamber 24. The replacement thrust chamber 24 will already be aligned with both the pump 22 and the motor 26.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed is:

1. A thrust box comprising:

a case having an interior, a first passageway and an opposing second passageway;

a shaft passing through the case and the first and second passageway;

a thrust runner secured to the shaft;

a pump ring attached to the thrust runner; and bearing pads;

wherein the pump ring comprises vanes configured to direct oil flow between bearing pads and the thrust runner.

2. The thrust box of claim 1, wherein the pump ring is releasably attached to the thrust runner.

3. The thrust box of claim 1, wherein the pump ring is permanently attached or integral with the thrust runner.

4. The thrust box of claim 1, wherein the pump ring is attached to the thrust runner with one or more bolts.

5. The thrust box of claim 1, further comprising a first and a second bearing located inside the case and wherein the first and the second bearing are configured to align the shaft relative to the case;

a first seal secured to the case by a first collar such that the first passageway and the shaft are sealed;

a second seal secured to the case by a second collar such that the second passageway and the shaft are sealed;

a thrust bearing mounted in the interior of the case; and an upthrust ring secured to the case and engaging the thrust bearing.

6. The thrust box of claim 1, wherein the interior is configured to be flooded with lubricant.

7. The thrust box of claim 6, wherein the interior is in fluid communication with a pump and a heat exchanger such that a lubricant can be pumped from the interior through the pump, through the heat exchanger, and back into the case interior.

8. The thrust box of claim 1, further comprising a spool attached to the case;

and one or more passageways extending through the spool; wherein the shaft extends through the spool attached to the case.

9. The thrust box of claim 1, wherein the thrust runner is secured to the shaft by a keyway and at least one radial groove on the shaft or a locking collar.

10. The thrust box of claim 1, wherein the thrust runner is secured to the shaft by a keyway and a single radial groove on the shaft.

11. The thrust box of claim 1, wherein the thrust runner is secured to the shaft by a keyway and at least one locking collar or threaded nut.

12. The thrust box of claim 1, further comprising a pump inlet and a seal between the pump inlet and the shaft.

13. The thrust box of claim 12, wherein a portion of the shaft adjacent to the seal is smooth.

14. The thrust box of claim 5, wherein the thrust bearing is a roller bearing.

15. In a thrust box comprising: a case having an interior, and a first passageway and an opposing second passageway; a shaft passing through the case and the first and second passageway; a first and second bearing located inside the case and holding the shaft in alignment relative to the case; a first seal secured to the case by a first collar and providing a seal between the first passageway and the shaft; a second seal secured to the case by a second collar and providing a seal between the second passageway and the shaft; a thrust bearing mounted in the interior of the case; an upthrust ring secured to the case and engaging the thrust bearing; a thrust runner keyed to the shaft wherein the improvement comprises:

a pump ring attached to the thrust runner configured to increase an oil flow rate in the thrust box;

and bearing pads wherein the pump ring directs oil flow between the bearing pads and the thrust runner.

* * * * *